US005575165A

United States Patent [19]

Roseberry

[11] Patent Number: 5,575,165

[45] Date of Patent: Nov. 19, 1996

[54] METHOD OF DENT REMOVAL USING A RESONANCE DAMPING VACUUM BLANKET

[75] Inventor: Thomas J. Roseberry, La Palma, Calif.

[73] Assignee: McDonnell Douglas Corporation, Huntington Beach, Calif.

[21] Appl. No.: 377,958

[22] Filed: Jan. 25, 1995

[51] Int. Cl.[6] ..... B21D 1/06

[52] U.S. Cl. ..... 72/56; 72/705

[58] Field of Search ..... 72/56, 705

[56] References Cited

U.S. PATENT DOCUMENTS

| | | | |
|---|---|---|---|
| 2,788,685 | 4/1957 | Clark | 72/479 |
| 2,799,318 | 7/1957 | Blucher . | |
| 3,060,879 | 10/1962 | Staba . | |
| 3,171,014 | 2/1965 | Ducati . | |
| 3,175,383 | 3/1965 | Levine . | |
| 4,252,008 | 2/1981 | Dibbens . | |
| 4,947,667 | 8/1990 | Gunkel et al. . | |

FOREIGN PATENT DOCUMENTS

| | | | |
|---|---|---|---|
| 234621 | 4/1986 | German Dem. Rep. | 72/705 |

*Primary Examiner*—Lowell A. Larson

*Attorney, Agent, or Firm*—Blakely, Sokoloff, Taylor & Zafman

[57] ABSTRACT

A repair kit for removing dents from a sheet of metal. The kit includes a sheet of damping material that is mounted to the surface of the metal. A vacuum can be pulled between the sheet metal and the damping material so that the surface of the damping material is secured to the metal. An electromagnetic device is inserted through an access hole in the damping device and energized to pull the dent out of the sheet metal. The damping material dampens any vibrational energy generated in the sheet metal and prevents "spring back" during the dent removal process.

9 Claims, 2 Drawing Sheets

METHOD OF DENT REMOVAL USING A RESONANCE DAMPING VACUUM BLANKET

BACKGROUND OF THE INVENTION

1. Field of the Invention

The present invention relates to a repair kit for removing dents from a sheet of metal.

2. Description of Related Art

The skin of an airplane is typically constructed with sheets of metal that are riveted to a frame. The sheet metal may become dented, thereby reducing the structural integrity of the aircraft. It is desirable to repair the aircraft by removing the dents from the skin.

Dents can be removed by pounding the deformed material with a mallet. Such a method is both time consuming and requires a certain level of skill. Additionally, pounding a dent out of an airplane skin may require the repair person to enter a generally inaccessible area of the aircraft.

In the more flexible areas, the electromagnetic forces will pull a sizable area of material surrounding the dented area. Stresses inherent to a formed sheet metal fabrication frequently result in the entire area returning to the original dented position or contour. This is known as "spring back" and is quite common in the forming of sheet metal.

There have been developed electromagnetic devices that create an attractive magnetic force which will pull the dent out of a sheet of metal. Electromagnetic dent removal devices can be placed on the outside of the airplane skin to allow an operator to remove dents without entering the aircraft. It has been found that the magnetic force of the device may cause the sheet metal to resonant. This is particularly true for flexible metal sheets. When resonance occurs, the energy emitted by the electromagnetic device further excites the resonance instead of pulling the dent. Consequently, either the dent is not pulled out of the skin, or the device requires more power to perform the dent removal operation. It would therefore be desirable to have a means for damping the resonance of the skin and preventing "spring back" during the dent removal process.

SUMMARY OF THE INVENTION

The present invention is a repair kit for removing dents from a sheet of metal. The kit includes a sheet of damping material that is mounted to the surface of the metal. A vacuum can be pulled between the sheet metal and the damping material so that the surface of the damping material is secured to the metal. An electromagnetic device is inserted through an access hole in the damping device and energized to pull the dent out of the sheet metal. The damping material dampens any vibrational energy generated in the sheet metal during the dent removal process and eliminates any "spring back" of the material.

BRIEF DESCRIPTION OF THE DRAWINGS

The objects and advantages of the present invention will become more readily apparent to those ordinarily skilled in the art after reviewing the following detailed description and accompanying drawings, wherein.

DETAILED DESCRIPTION OF THE INVENTION

Figure 1:
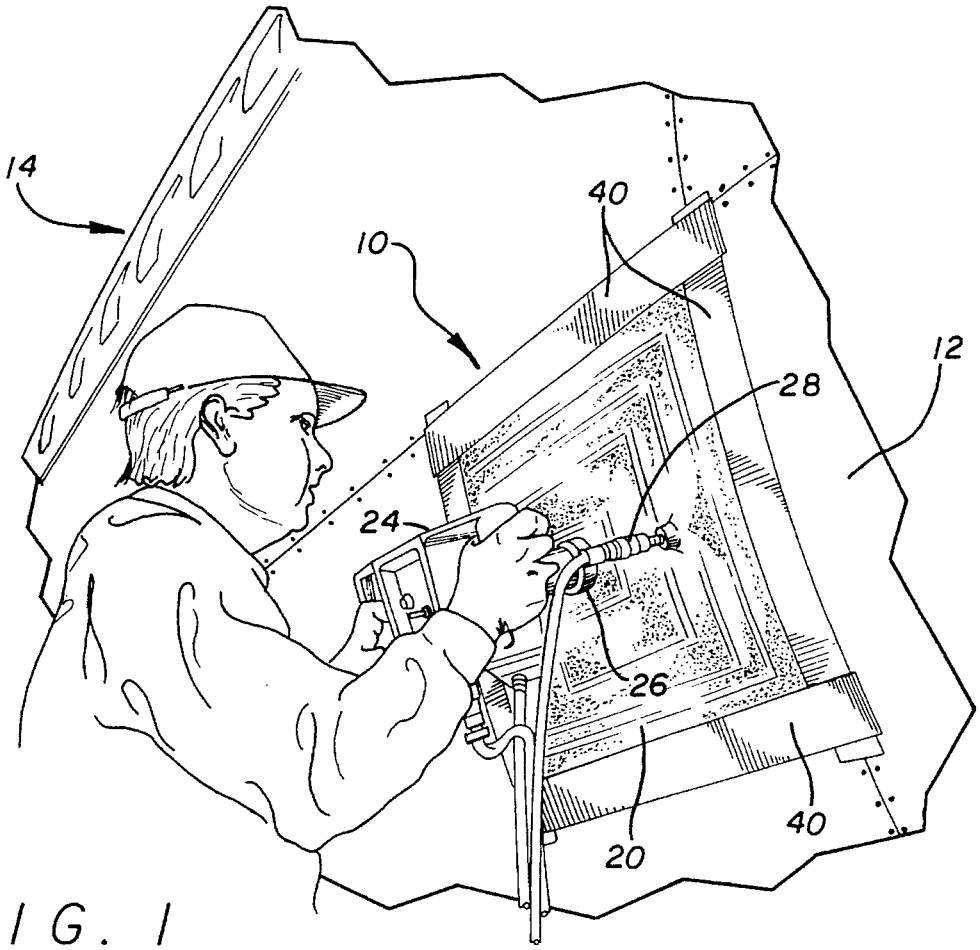
FIG. 1 is a perspective showing a repair kit of the present invention coupled to the skin of an airplane.

Referring to the drawings more particularly by reference numbers, FIG. 1 shows a repair kit 10 coupled to the skin 12 of an aircraft 14. The repair kit 10 is used to remove dents in the aircraft skin 12. Although a repair kit 10 to remove dents from aircraft skin 12 is shown and described, it is to be understood that the kit 10 can be used to remove dents from other sheets or structures. For example, the kit 10 can be used to remove dents from the body of an automobile.

Figure 2:
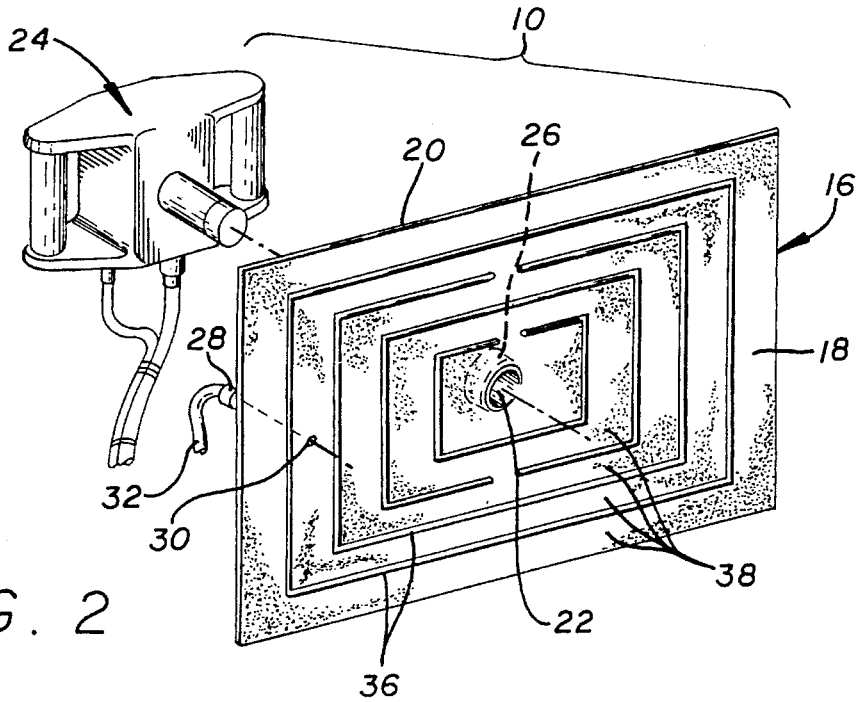
FIG. 2 is an exploded view of the repair kit.

As shown in FIG. 2, the repair kit 10 includes a sheet of damping material 16 which has an inner surface 18 and an outer surface 20. The damping sheet 16 has an access hole 22 that allows an electromagnetic device 24 to extend therethrough. The access hole 22 may have a rigid sleeve 26 to provide structural support for the hole 22.

The damping sheet 16 may also have an air hose connector 28 that extends into a secondary hole 30 of the sheet 16. The connector 28 is typically attached to a hose 32 which provides fluid communication with a vacuum source 34 such as a vacuum pump. The vacuum source 34 pulls a vacuum between the damping sheet 16 and the aircraft skin 12, so that a substantial portion of the second surface 20 is in contact with the skin 12. The damping sheet 16 may have a plurality of ridges 36 which define channels 38 throughout the second surface 20. The channels 38 allow the air to be evacuated across the second surface 20 of the sheet 16 and into the secondary hole 30.

The damping sheet 16 should be constructed from a material that will dampen any vibrational energy of the metal sheet 12. The damping sheet 16 should also be flexible enough to conform to the contour shape of the aircraft skin 12. In the preferred embodiment, the damping sheet is constructed from rubber or neoprene.

To remove a dent, the damping sheet 16 is attached to the aircraft skin 12. The sheet 16 can be attached to the aircraft skin 12 with strips of tape 40 that are fastened to the skin 12 and the edges of the sheet 16. The electromagnetic device 24 is inserted through the sleeve 26 and the hose 32 is coupled to the connector 28. A vacuum is then drawn in the space between the aircraft skin 12 and the second surface 20 of the damping sheet 16, so that the sheet 16 conforms to the contour of the skin 12.

Figure 3:
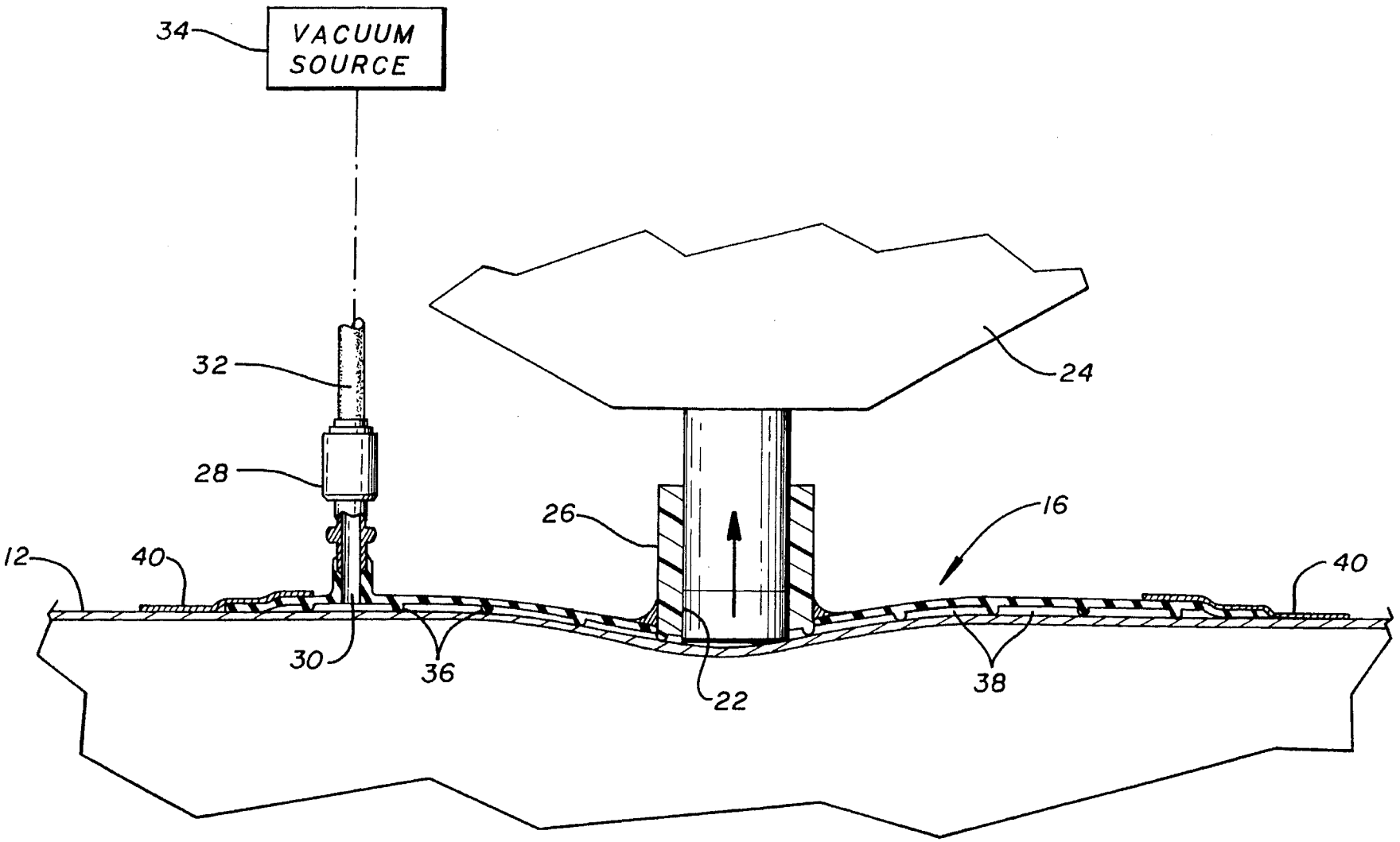
FIG. 3 is a sectional perspective view showing a dent being pulled out of the aircraft skin.

As shown in FIG. 3, the electromagnetic device 24 is energized to create an attractive magnetic force that pulls the dent out of the skin 12. The damping sheet 16 will absorb and dampen any vibrational energy that is created in the skin 12, as well as preventing "spring back", thereby increasing the efficiency of the electromagnetic device. When the dent is removed, the sheet 16, hose 32 and device 24 can be moved to a new location to remove another dent. The repair kit 10 allows dents to be removed without having to enter the aircraft 12, as well as preventing "spring back", thereby reducing the amount of time required to repair the skin.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A method for removing a dent from a sheet of metal, comprising the steps of:

a) mounting a sheet of damping material to the sheet metal;

b) coupling an electromagnetic device to the sheet metal; and, c) energizing said electromagnetic device to pull the dent out of the sheet metal, wherein said damping material dampens any vibrational energy and eliminates "spring back" generated by the pull of said electromagnetic device.

2. The method as recited in claim 1, further comprising the step of creating a vacuum between said damping sheet and the sheet metal to induce contact between said damping sheet and the sheet metal.

3. A repair kit that removes a dent from a skin of an airplane, comprising:

a sheet of damping material that is mounted to the skin of the airplane; and, an electromagnetic device that pulls the dent out of the skin.

4. The kit as recited in claim 3, wherein said damping material has an access hole that provides access to said electromagnetic device.

5. The kit as recited in claim 4, further comprising a sleeve located within said access hole.

6. The kit as recited in claim 3, further comprising a vacuum source that creates a vacuum between said damping sheet and the skin to induce contact between said damping sheet and the skin.

7. The kit as recited in claim 6, wherein said damping sheet has a plurality of ribs that define a plurality of channels in fluid communication with said vacuum source.

8. A method for removing a dent from a skin of an airplane, comprising the steps of:

a) mounting a sheet of damping material to the skin;

b) coupling an electromagnetic device to the skin; and, c) energizing said electromagnetic device to pull the dent out of the skin, wherein said damping material dampens any vibrational energy generated by the pull of said electromagnetic device.

9. The method as recited in claim 8, further comprising the step of creating a vacuum between said damping sheet and the skin to induce contact between said damping sheet and the skin.

* * * * *